United States Patent [19]

Pandola et al.

[11] Patent Number: 4,901,407

[45] Date of Patent: Feb. 20, 1990

[54] VEHICULAR SEAT BELT COVERING

[76] Inventors: Thomas A. Pandola; Carol A. Pandola, both of 7161 Rivol Rd., West Hills, Calif. 91307

[21] Appl. No.: 309,491

[22] Filed: Feb. 13, 1989

[51] Int. Cl.[4] ..... A44B 17/00

[52] U.S. Cl. ..... 24/633; 24/442; 24/574

[58] Field of Search ..... 24/633, 634, 574, 625, 24/487; 297/482; 2/DIG. 6

[56] References Cited

U.S. PATENT DOCUMENTS

| | | | |
|---|---|---|---|
| 3,123,080 | 3/1964 | Albertoni | 24/442 |
| 3,383,738 | 5/1968 | Fox et al. | 2/DIG. 6 |
| 3,484,908 | 12/1969 | Lamb | 24/574 |
| 4,120,052 | 10/1978 | Butler | 2/DIG. 6 |
| 4,502,194 | 3/1985 | Morris et al. | 24/633 |
| 4,624,033 | 11/1986 | Orton | 24/633 |
| 4,674,303 | 6/1987 | Salcone, II | 24/633 |
| 4,675,954 | 6/1987 | Gullickson | 24/633 |
| 4,678,205 | 7/1987 | Wold | 297/482 |
| 4,731,912 | 3/1988 | Boriskie et al. | 24/574 |

FOREIGN PATENT DOCUMENTS

| | | | |
|---|---|---|---|
| 1581996 | 12/1980 | United Kingdom | 297/482 |

*Primary Examiner*—Victor N. Sakran

*Attorney, Agent, or Firm*—Leon Gilden

[57] ABSTRACT

A vehicular seat belting covering is set forth for use in combination with the buckling ends of a seat belt wherein the covering is of a generally cylindrical configuration formed with an opening sized to approximate that of the release button of the associated buckle. The covering is formed of elastomeric woven material formed with outwardly extending fabric-type nap to provide a thermally neutral covering for the associated metallic seat belt buckles. A separate section formed with adhesive is utilized with one of a plurality of the seat belt coverings to complementarily fill the through-formed opening positionable and securable to the one of a pair of buckles formed with the outwardly extending buckle boss receivable within the other buckle provided with a receiving cavity. Optionally, a plurality of adhesive layers are positionable on either side of the opening for securement of the covering to an upper surface of an associated buckle with an adhesive or hook and loop fastener patch to adhere the covering to the other side of the associated buckle.

1 Claim, 1 Drawing Sheet

VEHICULAR SEAT BELT COVERING

BACKGROUND OF THE INVENTION

1. Field of the Invention

The field of invention relates to covering devices, and more particularly pertains to a new and improved vehicular seat belt covering to provide a thermally protective covering to an associated buckle pair to minimize associated heating of the buckle pair when exposed to sunlight.

2. Description of the Prior Art

The use of coverings of various types and for unique applications are well known in the prior art. The prior art has utilized coverings in a myriad of applications but has heretofore failed to provide a new and improved vehicular seat belt covering to prevent discomfort to an individual upon grasping of a buckle having been exposed to a heating environment, as typically found during the summer months.

For example, U.S. Pat. No. 3,397,913 to Fein sets forth a securably detachable covering overlying the flexible portion of an associated seat belt with the exception of the buckling members to provide a decorative covering to an associated seat belt.

U.S. Pat. No. 4,595,618 to Caringer sets forth a novelty device securably mounted to a seat belt provided with a sleeve for positioning of the seat belt through the sleeve with a decorative configuration fixedly secured to a forward portion of the sleeve to enhance the utilization of the seat belt by a child.

U.S. Pat. No. 4,678,205 to Wold sets forth a covering for utilization with a seat belt or safety harness to enhance the comfort of the flexible length of safety harness utilized.

U.S. Pat. No. 4,693,495 to Lapointe similarly sets forth a comfort adding covering for securement overlying a seat belt flexible portion to enhance the comfort of a user utilizing hook and loop fasteners to secure the cushion to the seat belt.

U.S. Pat. No. 4,699,401 to Saenz sets forth an additional flexible seat belt covering to provide a protective cushioning to a seat belt.

As such, it may be appreciated that there is a continuing need for a new and improved vehicular seat belt covering for encompassing the buckle engagement portions of the seat belt to overcome the problems of heat transmission to the buckles during exposure to extensive sunlight and which may be further compactly and readily secured to such buckles and in this respect, the present invention substantially fulfills this need.

SUMMARY OF THE INVENTION

In view of the foregoing disadvantages inherent in the known types of seat belt covering devices now present in the prior art, the present invention provides a vehicular seat belt covering wherein the same may be readily and effectively secured to opposed buckle portions of an associated seat belt and fixedly secured thereto as desired. As such, the general purpose of the present invention, which will be described subsequently in greater detail, is to provide a new and improved vehicular seat belt covering which has all the advantages of the prior art seat belt coverings and none of the disadvantages.

To attain this, the present invention comprises a vehicular seat belt covering formed of elastomeric base material with an outwardly extending moisture and heat absorbing nap extending outwardly to the base covering with a central opening to expose the release mechanism of an associated seat belt clasp. An adhesively securable plug section is securable within the opening when overlying the extending buckle house of the other seat belt pair. The seat belt covering is formed with optional adhesive strips therewithin to secure the covering to the associated seat belt buckles or alternatively, an optional hook and loop fastener patch is securable to the clasp and buckle portions of the seat belt locking members to secure the covering to the associated clasp and buckle members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vehicular seat belt covering which has all the advantages of the prior art seat belt coverings and none of the disadvantages.

It is another object of the present invention to provide a new and improved vehicular seat belt covering which may be easily and efficiently manufactured and marketed.

It is a further object of the present invention to provide a new and improved vehicular seat belt covering which is of a durable and reliable construction.

An even further object of the present invention is to provide a new and improved vehicular seat belt covering which is susceptible of a low cost of manufacture with regard to both materials and labor, and which accordingly is then susceptible of low prices of sale to the consuming public, thereby making such vehicular seat belt coverings economically available to the buying public.

Still yet another object of the present invention is to provide a new and improved vehicular seat belt covering which provides in the apparatuses and methods of the prior art some of the advantages thereof, while simultaneously overcoming some of the disadvantages normally associated therewith.

Still another object of the present invention is to provide a new and improved vehicular seat belt covering expandable and geometrically conforming to an associated locking member of a seat belt locking member couple.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
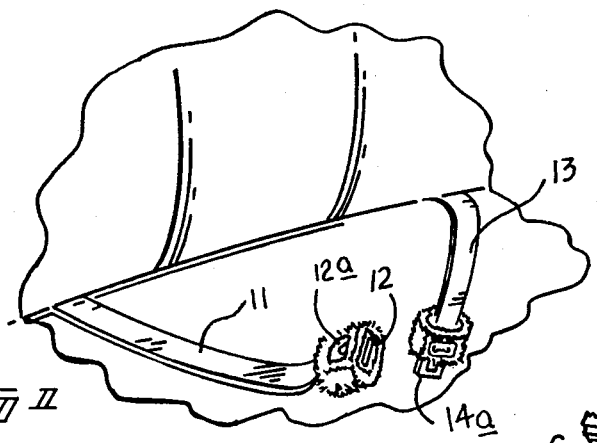
FIG. 1 is an isometric illustration of the instant invention secured to each locking member of a seat belt locking couple.

With reference now to the drawings, and in particular to FIGS. 1 to 5 thereof, a new and improved vehicular seat belt covering embodying the principles and concepts of the present invention and generally designated by the reference numeral 10 will be described.

More specifically, it will be noted that the vehicular seat belt covering 10 essentially comprises a first seat belt 11 of typically flexible construction formed with a clasp member 12 including a medially positioned receiving cavity and an overlying release button 12*a* on an upper surface thereof. A second seat belt 13 also of relatively flexible construction is formed with a buckle member 14 to provide the other of the locking couple defined by the respective clasp and buckle members 12 and 14. The seat belt covering 10 is formed as a generally elastomeric expandable cylindrical member to geometrically accommodate each member of the locking couple when positioned thereon. The vehicular seat belt covering 10 is further of a cylindrical length to substantially equal that of each locking couple to substantially be aligned with and encompass each member of the locking couple without providing overhanging material.

Each seat belt covering 10 is further formed with an elastomeric woven base 15 formed and having integrally secured thereof an outwardly extending moisture absorbing nap 16 to include such material as "terry cloth".

An opening 17 is formed in a through-extending manner through the side wall of the vehicular seat belt covering 10 somewhat medially thereof to be aligned with the release button 12*a* formed on the upper surface of the clasp member 12 to enable unobstructed access to the aforenoted release button 12*a*. Inasmuch as the buckle member 14 does not require the opening 17 as there is no need for access to a particular mechanism, a plug section 18 of a configurational opening equaling that of the opening 17 is securable to the upper surface of the buckle member 14 utilizing a first adhesive layer 19 with a peel-away protective strip 19*a* adhesively mountable onto the upper surface of the buckle member 14 to provide a continuous covering of the body of the buckle member 14. Exposing only the boss 14*a* of the rigid buckle member 14 for inter-engagement with the receiving cavity of the clasp member 12.

Figure 2:
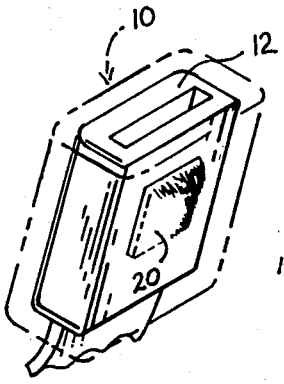
FIG. 2 is an isometric illustration of the instant invention in phantom illustrating the utilization of a hook and loop fastener patch secured to a rear surface of a locking member of the locking couple of a seat belt.

Securement of the seat belt covering 10 to an associated one of the locking couple is effected by a hook and loop fastener patch 20 adhesively securable to a lowermost surface of an associated locking couple, as illustrated in FIG. 2, or alternatively, a plurality of second adhesive layers 21 utilizing associated peel-away protective strips 21*a* are positioned on either side of the opening 17 for securement to an upper surface of an associated locking couple with a third adhesive layer 22 optionally secured to the interior of the seat belt covering 10 diametrically opposed to the opening 17 with an associated peel-away strip for securement to lower surface of an associated locking couple in lieu of utilizing the hook and loop fastener patch 20.

Figure 3:
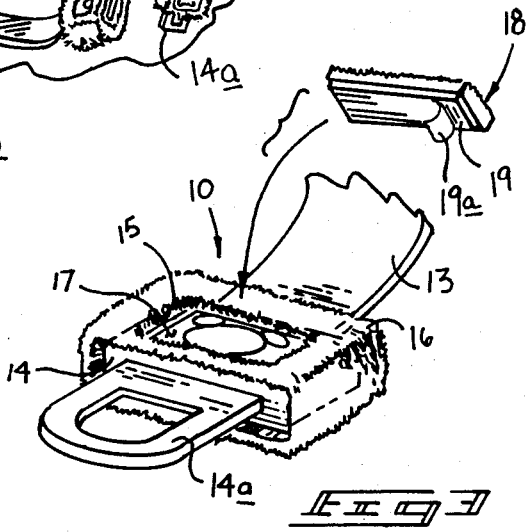
FIG. 3 is an isometric illustration of the instant invention setting forth the securement of the seat belt covering to a buckle of a seat belt locking couple.
Figure 5:
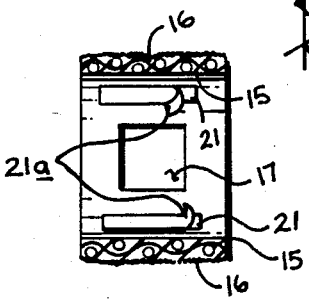
FIG. 5 is an orthographic view taken along the lines 5—5 of FIG. 4 in the direction indicated by the arrows.
Figure 4:
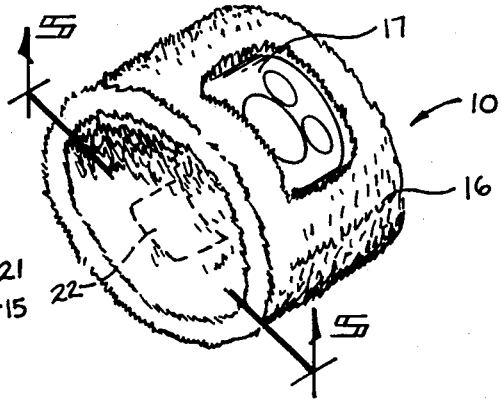
FIG. 4 is an isometric illustration of the instant invention.

It is understood in the utilization of the instant invention and upon covering the clasp and buckle members of the locking couple, the metallic locking couple will not be subject to an uncomfortable solar heating, as is commonly encountered during the summer months. Further, it may be appreciated that the elastomeric nature of the seat belt covering 10 enables the cylindrical configuration in its first position to geometrically accommodate the associated clasp and buckle members 12 and 14 respectively of the locking couple in a second expanded position, as illustrated in FIGS. 4 and 3 respectively.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A vehicular seat belt covering in combination with a clasp member and a buckle member comprising, a locking couple each formed at terminal ends of a flexible seat belt wherein the clasp member is formed with a release member oriented through an upper end of said clasp member and wherein said buckle member is formed with a solid buckle body including an outwardly extending locking boss receivable within said clasp member, said seat belt covering comprising, a plurality of elongate body members including a first and second elongate body member to respectively encompass the clasp member and buckle member respectively wherein the body members are each formed to include a continuous elastomeric base portion to enable stretching of each body member over each respective clasp and buckle member from a first cylindrical configuration to a second configuration geometrically accommodating each respective clasp and buckle member, and a through-extending opening formed through a wall of each body member, and wherein each first and second elongate body is further formed with outwardly extending fabric integrally secured to said elastomeric base portion, and further including a hook and loop fastener patch securable to each clasp and buckle member at a position diametrically opposed to said opening, and wherein an adhesive member is interiorly secured to each first and second elongate body diametrically opposed to said opening for securement to each respective clasp and buckle member, and wherein a plurality of further adhesive members are secured to an interior wall of each respective first and second elongate body at opposite sides of said opening, and further including a plug section formed with an additional adhesive member secured to a lowermost side of a further elastomeric body portion with outwardly extending further nap members extending outwardly thereof and formed of a geometrical configuration to complement that defined by said opening to secure said plug section to said buckle member when said second elongate body is enveloping said buckle member, and wherein each first and second elongate body is of a length equal to that of said clasp member and buckle body respectively to envelop and cover said clasp member and buckle body only.

* * * * *